US010119270B2

(12) United States Patent
Thornton et al.

(10) Patent No.: US 10,119,270 B2
(45) Date of Patent: Nov. 6, 2018

(54) EXTENDED SPAN TIMBER STRUCTURAL MEMBER

(71) Applicant: LOGGO IP PTY LTD IN ITS CAPACITY AS TRUSTEE FOR THORNTON IP TRUST, Oak Flats, New South Wales (AU)

(72) Inventors: Patrick Thornton, Oak Flats (AU); Peter Blair, Willoughby (AU)

(73) Assignee: LOGGO IP PTY LTD, Oak Flats, New South Whales (AU), IN ITS CAPACITY AS TRUSTEE FOR THRONTON IP TRUST ( * ) Notice: Subject to any disclaimer, the term of this patent is extended or adjusted under 35 U.S.C. 154(b) by 0 days.

(21) Appl. No.: 15/312,457

(22) PCT Filed: May 18, 2015

(86) PCT No.: PCT/AU2015/050249
§ 371 (c)(1),
(2) Date: Nov. 18, 2016

(87) PCT Pub. No.: WO2015/176125
PCT Pub. Date: Nov. 26, 2015

(65) Prior Publication Data

US 2017/0096813 A1 Apr. 6, 2017

(30) Foreign Application Priority Data

May 18, 2014 (AU) ..... 2014901839

(51) Int. Cl.
*E04B 2/02* (2006.01)
*E04B 2/70* (2006.01)
(Continued)

(52) U.S. Cl.
CPC ..... *E04B 2/02* (2013.01); *E04B 1/10* (2013.01); *E04B 1/486* (2013.01); *E04B 2/702* (2013.01);
(Continued)

(58) Field of Classification Search
CPC .... E04B 1/10; E04B 1/486; E04B 2001/2668; E04B 2001/2672; E04B 2001/3583;
(Continued)

(56) References Cited

U.S. PATENT DOCUMENTS 2,130,231 A * 9/1938 Forciea ..... E04B 2/702 403/346
2,403,934 A * 7/1946 Lindstrom ..... E04B 2/702 52/233
(Continued)

FOREIGN PATENT DOCUMENTS

DE 10202497 A1 10/2002
JP H10338991 A 12/1998
(Continued)

OTHER PUBLICATIONS

International Search Report dated Aug. 6, 2015 for corresponding International Patent Application PCT/AU2015/050249 filed May 18, 2015.
(Continued)

*Primary Examiner* — Robert Canfield
(74) *Attorney, Agent, or Firm* — David D. Brush; Westman, Champlin & Koehler, P.A.

(57) ABSTRACT

A timber structural member includes: a first timber round having a first cooperating longitudinal surface, a second timber round having a second and a third cooperating longitudinal surfaces, and a third timber round having a fourth cooperating longitudinal surface. The first cooperating surface cooperates with the second cooperating surface,
(Continued)

and the third cooperating surface cooperates with the fourth cooperating surface. The timber rounds are secured together to form a structurally integral unit in which the first cooperating surface is in contact with the second cooperating surface, and the third cooperating surface is in contact with the fourth cooperating surface, and the first, second and third timber rounds are substantially parallel to each other. The timber rounds are secured to each other by a plurality of spaced fasteners provided at acute and obtuse angles from a longitudinal axis of the structural member and extending through the timber rounds.

15 Claims, 6 Drawing Sheets

(51) Int. Cl.
*E04B 1/10* (2006.01)
*E04B 1/26* (2006.01)
*E04B 1/48* (2006.01)

(52) U.S. Cl.
CPC ..... *E04B 2001/2668* (2013.01); *E04B 2001/2672* (2013.01); *E04B 2002/0202* (2013.01); *E04B 2002/023* (2013.01); *E04B 2002/0213* (2013.01); *E04B 2002/0232* (2013.01); *E04B 2002/0245* (2013.01)

(58) Field of Classification Search
CPC ..... E04B 2/702; E04B 2002/0202; E04B 2002/023; E04B 2002/0254; E04B 2002/0245; E04B 2002/0213; E04B 2/02; E04C 3/12; E04C 3/122; E04C 3/14; E04C 3/292
USPC .. 52/223.7, 223.8, 223.9, 233, 285.4, 585.1, 52/843, 847, 79.2, 284, 285.1, 314, 565, 52/586.1, 591.4, 574
See application file for complete search history.

(56) References Cited

U.S. PATENT DOCUMENTS

| | | | | | |
|---|---|---|---|---|---|
| 2,416,162 | A * | 2/1947 | Drake | E04B 2/702 | 144/136.7 |
| 4,356,676 | A * | 11/1982 | Hauptman | E04B 1/6815 | 428/317.3 |
| 4,742,657 | A * | 5/1988 | Veech | E04B 2/705 | 403/294 |
| 4,905,409 | A * | 3/1990 | Cole | A01G 1/08 | 47/33 |
| 5,277,008 | A * | 1/1994 | Saulez | E04B 2/08 | 52/233 |
| 5,577,357 | A * | 11/1996 | Civelli | E04B 2/702 | 52/233 |
| 6,173,906 | B1 * | 1/2001 | Von Kerens | E04H 17/1413 | 239/273 |
| 6,200,061 | B1 | 3/2001 | Goto | | |
| 8,225,565 | B2 * | 7/2012 | Cox | E04B 2/702 | 52/223.4 |
| 2006/0179741 | A1 * | 8/2006 | Sohm | E04B 5/12 | 52/223.7 |
| 2007/0130852 | A1 | 6/2007 | Sieber | | |
| 2009/0133345 | A1 * | 5/2009 | Wrightman | E04B 2/702 | 52/233 |
| 2011/0283639 | A1 * | 11/2011 | Thornton | E04C 3/14 | 52/233 |
| 2016/0194869 | A1 * | 7/2016 | Thornton | E04C 3/12 | 52/233 |

FOREIGN PATENT DOCUMENTS

| | | | |
|---|---|---|---|
| JP | 200702581 | A | 1/2007 |
| WO | 2010057243 | A1 | 5/2010 |

OTHER PUBLICATIONS

Written Opinion of the International Searching Authority dated Aug. 6, 2015 for corresponding International Patent Application PCT/AU2015/050249 filed May 18, 2015.

* cited by examiner

EXTENDED SPAN TIMBER STRUCTURAL MEMBER

CROSS REFERENCE TO RELATED APPLICATIONS

The present application is a Section 371 National Stage Application of International Application No. PCT/AU2015/050249, filed May 18, 2015, which is incorporated by reference in its entirety and published as WO 2015/176125 A1 on Nov. 26, 2015, in English.

FIELD OF THE INVENTION

The present invention is directed to the field of construction, and in particular building construction. Included within the present invention are structural timber members capable of bearing loads required in applications such as bearers, floor joists, roof rafters, beams, columns and the like.

BACKGROUND TO THE INVENTION

Timber is a renewable natural resource useful in the construction of buildings and other structures. When trees are harvested there is significant wastage of woody material. Typically this material is used in relatively low value applications such as fuel for heat generation, wood chips, landscaping products, the production of bio fuels and the like. While these are effective uses of waste products they do not add value to the product, and merely minimise economic loss on the cost of timber production.

Timber products act to sequester carbon dioxide for decades, thereby assisting in limiting climate change. This is a practical advantage and a point of difference in marketing the sustainable forestry industry, and the products produced from timber. However, these advantages are diminished or lost where woody waste material is combusted or otherwise transformed to release carbon dioxide. Many current uses for wood waste release significant amounts of carbon dioxide into the atmosphere, thereby exacerbating climate change and undermining the carbon sequestration advantages of timber products.

As one example, so-called "peeler cores" (which are typically 60 to 80 mm diameter) result from logging for plywood products. Peeler cores are often used to fuel forest kilns, or chipped for use in landscape applications. Wood of diameter less than 80 mm diameter is often left on the forest floor.

A further problem in the art is the significant time taken for a tree to be ready for harvest. The main trunk and branches of the tree must be of sufficient diameter to allow for the economical production of products such as sawn timber. A shorter production cycle would allow for increases in production capacity for a given area of land as a function of time.

The present Applicant has previously proposed load bearing timber members in international patent application PCT/AU2009/001453 (published as WO/2010/057243). While effective in structural applications, these prior art beams are formed from timbers that are implicated in some of the problems referred to supra in so far as the component timbers are necessarily harvested in a wasteful manner Furthermore, these prior art beams are formed from relatively expensive timbers and for some applications are excessive in weight or moisture content.

It is an aspect of the present invention to provide timber structural beams than can be fabricated with less wastage of woody material and/or from timbers that are faster to harvest and/or more economically and/or at a lighter weight. It is a further aspect to provide an alternative to prior art timber beams.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed before the priority date of each provisional claim of this application.

SUMMARY OF THE INVENTION

In a first aspect the present invention provides a structural member comprising: a first timber round having a first cooperating surface extending longitudinally along the length thereof, a second timber round having a second and a third cooperating surfaces extending longitudinally along the length thereof, and a third timber round having a fourth cooperating surface extending longitudinally along the length thereof wherein, the first cooperating surface is shaped to cooperate with the second cooperating surface, and the third cooperating surface is shaped to cooperate with the fourth cooperating surface, the first, second and third timber rounds are secured together to form a structurally integral unit in which the first cooperating surface is in contact with the second cooperating surface, and the third cooperating surface is in contact with the fourth cooperating surface, and the first, second and third timber rounds are substantially parallel to each other, and wherein the first, second and third timber rounds are secured to each other by a plurality of fasteners spaced along the length of the member, the plurality of fasteners comprising fasteners provided at both acute and obtuse angles from a longitudinal axis of the structural member, the fasteners extending through the first, second and third timber rounds.

The present invention further provides a structural member comprising: a first timber round having a first cooperating surface extending longitudinally along the length thereof, a second timber round having a second and a third cooperating surfaces extending longitudinally along the length thereof, and a third timber round having fourth and fifth cooperating surfaces extending longitudinally along the length thereof, and fourth timber round having a sixth cooperating surface extending longitudinally along the length thereof wherein, the first cooperating surface is shaped to cooperate with the second cooperating surface, and the third cooperating surface is shaped to cooperate with the fourth cooperating surface, and the fifth cooperating surface is shaped to cooperate with the sixth cooperating surface, the first, second, third and fourth timber rounds are secured together to form a structurally integral unit in which the first cooperating surface is in contact with the second cooperating surface, and the third cooperating surface is in contact with the fourth cooperating surface, and the fifth cooperating surface is in contact with the sixth cooperating surface, and the first, second, third and fourth timber rounds are substantially parallel to each other, and wherein the first, second, third and fourth timber rounds are secured to each other by a plurality of fasteners spaced along the length of the member, the plurality of fasteners comprising fasteners provided at both acute and obtuse angles from a longitudinal axis of the structural member, the fasteners extending through the first, second, third and fourth timber rounds.

The present invention further provides a structural member comprising: a first timber round having a first cooperating surface extending longitudinally along the length thereof, a second timber round having a second and a third cooperating surfaces extending longitudinally along the length thereof, and a third timber round having fourth and fifth cooperating surfaces extending longitudinally along the length thereof, and a fourth timber round having sixth and seventh cooperating surfaces extending longitudinally along the length thereof, and a fifth timber round having an eighth cooperating surface extending longitudinally along the length thereof wherein, the first cooperating surface is shaped to cooperate with the second cooperating surface, and the third cooperating surface is shaped to cooperate with the fourth cooperating surface, and the fifth cooperating surface is shaped to cooperate with the sixth cooperating surface, and the seventh cooperating surface is shaped to cooperate with the eighth cooperating surface, the first, second, third, fourth and fifth timber rounds are secured together to form a structurally integral unit in which the first cooperating surface is in contact with the second cooperating surface, and the third cooperating surface is in contact with the fourth cooperating surface, and the fifth cooperating surface is in contact with the sixth cooperating surface, and the seventh cooperating surface is in contact with the eight cooperating surface, and the first, second third, fourth and fifth timber rounds are substantially parallel to each other, and wherein the first, second, third, fourth and fifth timber rounds are secured to each other by a plurality of fasteners spaced along the length of the member, the plurality of fasteners comprising fasteners provided at both acute and obtuse angles from a longitudinal axis of the structural member, the fasteners extending through the first, second, third, fourth and fifth timber rounds.

The present invention further provides a structural member comprising: a first timber round having a first cooperating surface extending longitudinally along the length thereof, a second timber round having a second and a third cooperating surfaces extending longitudinally along the length thereof, and a third timber round having fourth and fifth cooperating surfaces extending longitudinally along the length thereof, and a fourth timber round having sixth and seventh cooperating surfaces extending longitudinally along the length thereof, and a fifth timber round having eighth and ninth cooperating surfaces extending longitudinally along the length thereof, and a sixth timber round having a tenth cooperating surface extending longitudinally along the length thereof wherein, the first cooperating surface is shaped to cooperate with the second cooperating surface, and the third cooperating surface is shaped to cooperate with the fourth cooperating surface, and the fifth cooperating surface is shaped to cooperate with the sixth cooperating surface, and the seventh cooperating surface is shaped to cooperate with the eighth cooperating surface, and the ninth cooperating surface is shaped to cooperate with the tenth cooperating surface, the first, second, third, fourth, fifth and sixth timber rounds are secured together to form a structurally integral unit in which the first cooperating surface is in contact with the second cooperating surface, and the third cooperating surface is in contact with the fourth cooperating surface, and the fifth cooperating surface is in contact with the sixth cooperating surface, and the seventh cooperating surface is in contact with the eighth cooperating surface, and the ninth cooperating surface is in contact with the tenth cooperating surface, and the first, second third, fourth, fifth and sixth timber rounds are substantially parallel to each other, and wherein the first, second, third, fourth, fifth and sixth timber rounds are secured to each other by a plurality of fasteners spaced along the length of the member, the plurality of fasteners comprising fasteners provided at both acute and obtuse angles from a longitudinal axis of the structural member, the fasteners extending through the first, second, third, fourth, fifth and sixth timber rounds.

The present invention further provides a structural member comprising: a first timber round having a first cooperating surface extending longitudinally along the length thereof, a second timber round having a second and a third cooperating surfaces extending longitudinally along the length thereof, and a third timber round having fourth and fifth cooperating surfaces extending longitudinally along the length thereof, and a fourth timber round having sixth and seventh cooperating surfaces extending longitudinally along the length thereof, and a fifth timber round having eighth and ninth cooperating surfaces extending longitudinally along the length thereof, and a sixth timber round having tenth and eleventh cooperating surfaces extending longitudinally along the length thereof, and a seventh timber round having a twelfth cooperating surface extending longitudinally along the length thereof wherein, the first cooperating surface is shaped to cooperate with the second cooperating surface, and the third cooperating surface is shaped to cooperate with the fourth cooperating surface, and the fifth cooperating surface is shaped to cooperate with the sixth cooperating surface, and the seventh cooperating surface is shaped to cooperate with the eighth cooperating surface, and the ninth cooperating surface is shaped to cooperate with the tenth cooperating surface, and the eleventh cooperating surface shaped to cooperate with the twelfth cooperating surface, the first, second, third, fourth, fifth, sixth and seventh timber rounds are secured together to form a structurally integral unit in which the first cooperating surface is in contact with the second cooperating surface, and the third cooperating surface is in contact with the fourth cooperating surface, and the fifth cooperating surface is in contact with the sixth cooperating surface, and the seventh cooperating surface is in contact with the eighth cooperating surface, and the ninth cooperating surface is in contact with the tenth cooperating surface, and the eleventh cooperating surface is in contact with the twelfth cooperating surface, and the first, second third, fourth, fifth, sixth and seventh timber rounds are substantially parallel to each other, and wherein the first, second, third, fourth, fifth, sixth and seventh timber rounds are secured to each other by a plurality of fasteners spaced along the length of the member, the plurality of fasteners comprising fasteners provided at both acute and obtuse angles from a longitudinal axis of the structural member, the fasteners extending through the first, second, third, fourth, fifth, sixth and seventh timber rounds.

In one embodiment, one or more of the timber rounds, or all of the timber rounds, has/have a diameter of less than about 125 mm, or about 100 mm, or about 75 mm, or about 70 mm, or about 65 mm, or about 60 mm, or about 55 mm, or about 50 mm, or about 45 mm, or about 40 mm. In another embodiment, one or more of the timber rounds, or all of the timber rounds, has/have a diameter of less than about 60 mm. In another embodiment, one or more of the timber rounds, or all of the timber rounds, is/are a peeler core.

In one embodiment, the plurality of fasteners includes adjacent fasteners provided at alternating acute and obtuse angles to the longitudinal axis of the structural member. In another embodiment, the fasteners are applied at an acute angle of between about 10° to about 70° to the longitudinal axis of the structural member, and at an obtuse angle of between about 110° to 170° to the longitudinal axis of the structural member. In another embodiment, the fasteners are applied at an acute angle of between about 25° and about 55° to the longitudinal axis of the structural member, and at an obtuse angle of between about 125° and about 155° to the longitudinal axis of the structural member.

In one embodiment, the timber structural member comprises one or more holes interposed between adjacent acute and obtuse angled holes. In another embodiment, the hole(s) interposed between adjacent acute and obtuse angled holes are at an angle which bisects the angle made by the adjacent acute and obtuse holes. In another embodiment the hole(s) interposed between adjacent acute and obtuse angled holes are at an angle substantially orthogonal to a flat cooperating surface of the timber structural member.

In one embodiment, the acute and obtuse angled holes and/or the interposed holes are disposed along the plane running along the central longitudinal axis of the timber structural member.

In one embodiment, the first cooperating surface is a substantially flat surface provided by removing a minor segment along the length of the first timber round, the second cooperating surface is a substantially flat surface provided by removing a minor segment along the length of the second timber round, the third cooperating surface is a substantially flat surface provided by removing a minor segment along the length of the second timber round, the fourth cooperating surface is a substantially flat surface provided by removing a minor segment along the length of the third timber round, the fifth cooperating surface (where present) is a substantially flat surface provided by removing a minor segment along the length of the third timber round, the sixth cooperating surface (where present) is a substantially flat surface provided by removing a minor segment along the length of the fourth timber round, the seventh cooperating surface (where present) is a substantially flat surface provided by removing a minor segment along the length of the fourth timber round, the eighth cooperating surface (where present) is a substantially flat surface provided by removing a minor segment along the length of the fifth timber round, the ninth cooperating surface (where present) is a substantially flat surface provided by removing a minor segment along the length of the fifth timber round, the tenth cooperating surface (where present) is a substantially flat surface provided by removing a minor segment along the length of the sixth timber round, the eleventh cooperating surface (where present) is a substantially flat surface provided by removing a minor segment along the length of the sixth timber round, and the twelfth cooperating surface (where present) is a substantially flat surface provided by removing a minor segment along the length of the seventh timber round.

In one embodiment, the first, second, third, fourth, fifth (where present), sixth (where present), seventh (where present), eighth (where present), ninth (where present), tenth (where present), eleventh (where present), or twelfth (where present) substantially flat cooperating surface is parallel to any other substantially flat cooperating surface of the timber structural member.

In one embodiment, the first, second, third, fourth, fifth (where present), sixth (where present), seventh (where present), eighth (where present), ninth (where present), tenth (where present), eleventh (where present), and twelfth (where present) substantially flat cooperating surfaces are parallel to each other.

In one embodiment, the structural member is provided with a plurality of holes passing through the first, second, third, fourth (where present), fifth (where present), sixth (where present), and seventh (where present) rounds, each hole being shaped to receive one of the plurality of fasteners. In another embodiment, the plurality of holes includes holes formed at an acute angle to the longitudinal axis of the structural member and holes formed at an obtuse angle to the longitudinal axis of the structural member. In another embodiment, the fasteners are secured in the holes by an adhesive. In one embodiment, the holes are sized to allow sufficient clearance between their edges and the fasteners to allow each fastener to be encapsulated by the adhesive within the relevant hole. In another embodiment, the encapsulation of the fasteners by the adhesive prevents the fasteners from contacting the sides of the holes in which they are located. In another embodiment, the ends of the fasteners are provided with caps, the caps preventing exposure of the ends of the fasteners to the environment.

In one embodiment, wherein the fasteners are reinforcement bars.

In one embodiment, an end of the first timber round is provided with a first radial cut, and an end of the second timber round is provided with a second radial cut, and an end of the third timber round is provided with a third radial cut, and an end of the fourth timber round (where present) is provided with a fourth radial cut, and an end of the fifth timber round (where present) is provided with a fifth radial cut, and an end of the sixth timber round (where present) is provided with a sixth radial cut, and an end of the seventh timber round (where present) is provided with a seventh radial cut, the ends of the first, second third, fourth (where present), fifth (where present), sixth (where present), and seventh (where present) timber rounds being adjacent one another in the timber structural member, and the radial cuts shaped and positioned to allow the timber structural member to engage with a further member, the further member having a rounded cross-section.

In one embodiment, the axes of the first, second, third, fourth (where present), fifth (where present), sixth (where present) and seventh (where present) radial cuts are aligned. In another embodiment, the axes of the first, second, third, fourth (where present), fifth (where present), sixth (where present), and seventh (where present) radial cuts are parallel. In another embodiment, the axes of the first and/or second and/or third and/or fourth (where present), and or fifth (where present) and/or seventh (where present) radial cuts are angled to allow the timber structural member to form an angled connection with the further timber round.

In one embodiment, an end of the first timber round is provided with a first axial bore sized to receive a first connecting dowel, and an end of the second timber round is provided with a second axial bore sized to receive a second connecting dowel, and an end of the third timber round is provided with a third axial bore sized to receive a third connecting dowel, and an end of the fourth timber round (where present) is provided with a fourth axial bore sized to receive a fourth connecting dowel, and an end of the fifth timber round (where present) is provided with a fifth axial bore sized to receive a fifth connecting dowel, and an end of the sixth timber round (where present) is provided with a sixth axial bore sized to receive a sixth connecting dowel, and an end of the seventh timber round (where present) is provided with a seventh axial bore sized to receive a seventh connecting dowel the ends of the first, second, third, fourth (where present), fifth (where present), sixth (where present), and seventh (where present) timber rounds being adjacent one another in the timber structural member.

In one embodiment, the first connecting dowel is centrally positioned within the first bore to be coaxial with the first timber round, and the second connecting dowel is centrally positioned within the second bore to be coaxial with the second timber round, and the third connecting dowel is centrally positioned within the third bore to be coaxial with the third timber round, and the fourth connecting dowel (where present) is centrally positioned within the fourth bore to be coaxial with the fourth timber round, and the fifth connecting dowel (where present) is centrally positioned within the fifth bore to be coaxial with the fifth timber round, and the sixth connecting dowel (where present) is centrally positioned within the sixth bore to be coaxial with the sixth timber round, and the seventh connecting dowel (where present) is centrally positioned within the seventh bore to be coaxial with the seventh timber round.

In one embodiment, the first, second, third, fourth (where present), fifth (where present), sixth (where present), and seventh (where present) connecting dowels are centred respectively in the first, second, third, fourth (where present), fifth (where present), sixth (where present), and seventh (where present) bores by centring rings.

In one embodiment, the timber structural member has a length being a standard length used in building construction. In another embodiment, the timber structural member has a length of about 1200 mm, or about 2400 mm, or about 3600 mm.

In one embodiment, the connecting dowels are selected from a group comprising a mild steel rod and a high strength steel rod. In another embodiment, the connecting dowels are secured in the respective bores by an adhesive.

In one embodiment, the bores are sized to allow sufficient clearance between their edges and the relevant connecting dowel to allow the connecting dowel to be encapsulated by the adhesive within the relevant bore.

In one embodiment, the first timber round is secured to the second timber round, and the second timber round is connected to the third timber round, and the third timber round is connected to the fourth timber round (where present), and the fourth timber round is connected to the fifth timber round (where present), and the fifth timber round is connected to the sixth timber round (where present), and the sixth timber round is connected to the seventh timber round (where present), by use of an adhesive applied to the first and/or second and/or third and/or fourth and/or fifth (where present) and/or sixth (where present) and/or seventh (where present) and/or eighth (where present) and/or ninth (where present) and/or tenth (where present) and/or eleventh (where present) and/or twelfth (where present) cooperating surfaces.

In a further aspect, the present invention provides an extended span timber structural member comprising two or more timber structural members as described herein, the timber structural members being connected to each other by the end faces. In one embodiment, the timber structural member has a length of greater than 3 about meters.

In one embodiment, the extended span timber structural member comprises: a connecting member, and a continuous recess formed across two abutting timber rounds, wherein the connecting member is seated in the recess thereby straddling the abutting end faces of the two timber rounds.

In one embodiment, the recesses are formed on non-end faces of the abutting timber rounds.

In one embodiment, the end faces are staggered.

In one embodiment, the connecting member is substantially centred on the longitudinal axis of the member.

In one embodiment, the connecting member is disposed substantially mid-way between two fasteners.

In one embodiment, the continuous recess extends into a non-end face of an underlying or overlying timber round such that the connecting member is seated in the recess thereby straddling (i) the abutting end faces of the two timber rounds, and (ii) the interface between the abutting two timber rounds and the underlying or overlying timber round.

In one embodiment, the connecting member is a key or functional equivalent thereof.

In one embodiment, the connecting member is generally rectangular prismatic.

In a further aspect of the present invention there is provided a method for fabricating a timber structural member, the method comprising the steps of: providing a first timber round having a first cooperating surface extending longitudinally along the length thereof, providing a second timber round having a second and a third cooperating surfaces extending longitudinally along the length thereof, providing a third timber round having a fourth cooperating surface, and optionally a fifth cooperating surface extending longitudinally along the length thereof, optionally providing a fourth timber round having a sixth cooperating surface, and optionally a seventh cooperating surface extending longitudinally along the length thereof, optionally providing a fifth timber round having an eighth cooperating surface, and optionally a ninth cooperating surface extending longitudinally along the length thereof, optionally providing a tenth timber round having a sixth cooperating surface, and optionally a eleventh cooperating surface extending longitudinally along the length thereof, and optionally providing a seventh timber round having a twelfth cooperating surface, and extending longitudinally along the length thereof, wherein, the first cooperating surface is shaped to cooperate with the second cooperating surface, and the third cooperating surface is shaped to cooperate with the fourth cooperating surface, securing the first, second, third, fourth (where present), fifth (where present), sixth (where present), and seventh (where present) timber rounds together to form a structurally integral unit in which the first cooperating surface is in contact with the second cooperating surface, and the third cooperating surface is in contact with the fourth cooperating surface, and the fifth cooperating surface (where present) is in contact with the sixth cooperating surface (where present), and the seventh cooperating surface (where present) is in contact with the eight cooperating surface (where present), and the ninth cooperating surface (where present) is in contact with the tenth cooperating surface (where present), and the eleventh cooperating surface (where present) is in contact with the twelfth cooperating surface (where present), and the first, second, third, fourth (where present), fifth (where present), sixth (where present), and seventh (where present) timber rounds are substantially parallel to each other, and wherein the step of securing comprises the step of applying a plurality of fasteners spaced along the length of the member at both acute and obtuse angles from a longitudinal axis of the structural member such that the fasteners extend through the first, second, third, fourth (where present), fifth (where present), sixth (where present), and seventh (where present) timber rounds.

In one embodiment, the method comprises the step of applying one or more fasteners interposed between adjacent acute and obtuse angled fasteners.

In one embodiment of the method, one or more of the timber rounds, or all of the timber rounds, has/have a diameter of less than about 125 mm, or about 100 mm, or about 75 mm, or about 70 mm, or about 65 mm, or about 60 mm, or about 55 mm, or about 50 mm, or about 45 mm, or about 40 mm. In another embodiment, one or more of the timber rounds, or all of the timber rounds, has/have a diameter of less than about 60 mm. In another embodiment, one or more of the timber rounds, or all of the timber rounds, is/are a peeler core.

In one embodiment of the method, the plurality of fasteners comprise adjacent fasteners provided at alternating acute and obtuse angles to the longitudinal axis of the structural member.

In one embodiment of the method, the fasteners are applied at an acute angle of between about 10° to about 70° to the longitudinal axis of the structural member, and at an obtuse angle of between about 110° to 170° to the longitudinal axis of the structural member. In another embodiment the fasteners are applied at an acute angle of between about 25° and about 55° to the longitudinal axis of the structural member, and at an obtuse of about 125° to about 155° to the longitudinal axis of the structural member.

In a further aspect, the present invention provides a timber structural member produced by the method as described herein.

DETAILED DESCRIPTION OF THE INVENTION

Figure 1:
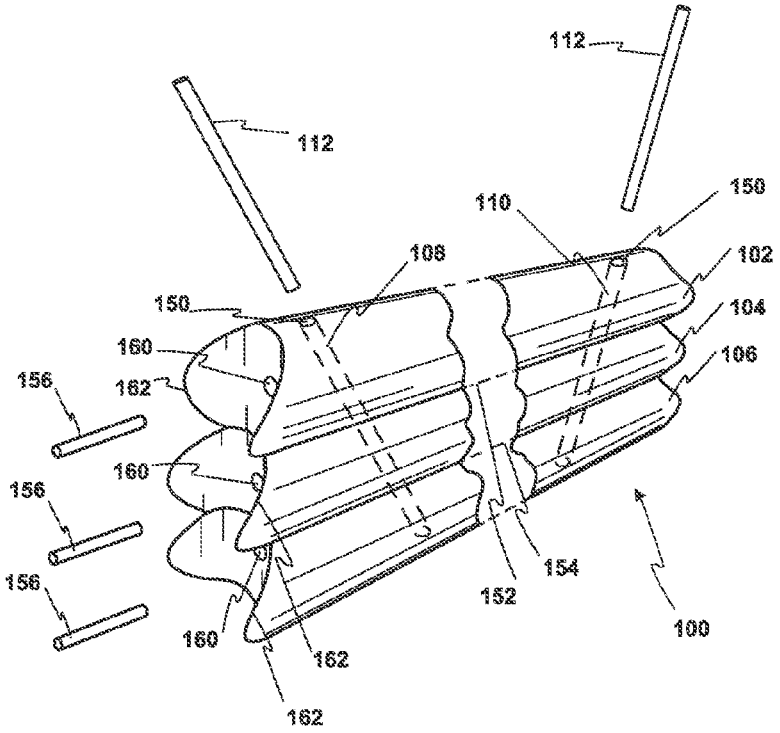
FIG. 1 shows a perspective view of a structural member in accordance with an embodiment of the present invention.

After considering this description it will be apparent to one skilled in the art how the invention is implemented in various alternative embodiments and alternative applications. However, although various embodiments of the present invention will be described herein, it is understood that these embodiments are presented by way of example only, and not limitation. As such, this description of various alternative embodiments should not be construed to limit the scope or breadth of the present invention. Furthermore, statements of advantages or other aspects apply to specific exemplary embodiments, and not necessarily to all embodiments covered by the claims.

Throughout the description and the claims of this specification the word "comprise" and variations of the word, such as "comprising" and "comprises" is not intended to exclude other additives, components, integers or steps.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may.

In a first aspect, the present invention provides a structural member comprising:

a first timber round having a first cooperating surface extending longitudinally along the length thereof, a second timber round having a second and a third cooperating surfaces extending longitudinally along the length thereof, and a third timber round having a fourth cooperating surface extending longitudinally along the length thereof wherein, the first cooperating surface is shaped to cooperate with the second cooperating surface, and the third cooperating surface is shaped to cooperate with the fourth cooperating surface, the first, second and third timber rounds are secured together to form a structurally integral unit in which the first cooperating surface is in contact with the second cooperating surface, and the third cooperating surface is in contact with the fourth cooperating surface, and the first, second and third timber rounds are substantially parallel to each other, and wherein the first, second and third timber rounds are secured to each other by a plurality of fasteners spaced along the length of the member, the plurality of fasteners comprising fasteners provided at both acute and obtuse angles from a longitudinal axis of the structural member, the fasteners extending through the first, second and third timber rounds.

Applicant proposes that beams having significant load bearing capacity may be formed by the use of three of more timber rounds fastened together, each timber round being of relatively small diameter. The use of small diameter rounds for producing a load bearing member is a significant departure from the prior art. At the filing date of this application, timber rounds of small diameter were thought to be of no use (or at least limited use) in building construction given the lack of load bearing capability of members having a limited cross sectional area. In some embodiments, 4, 5, 6, or 7 timber rounds are used.

The present Applicant has discovered that beams having three or more timber rounds, with the rounds fastened together in a specified manner, provide a beam having an unexpected load bearing capacity which is greater than the additive capacity of the individual rounds.

Another advantage of some embodiments includes a lower weight per unit length of member. The avoidance of members having a large cross-sectional area may, in some embodiments, provide for a lighter product. This assists in lowering freight costs and easing handling.

Weight advantages are also gained by the ease of drying smaller rounds, as discussed further infra.

A further advantage of some embodiments is a lower cost per unit length. As discussed in the Background section, many parts of a tree are wasted in the felling and milling processes. The present members may be formed from such waste, and indeed in some instances from branches that are ordinarily left on the forest floor to decompose.

Another advantage for some embodiments is that the relatively small rounds dry faster and/or to a greater extent and/or completely. Smaller rounds have a greater surface area to volume ratio, and so moisture is more quickly and/or more completely extracted from the wood. Kiln drying can be an important step in the lumber production process, ensuring that gross dimensional changes through shrinkage are confined to the drying process. Ideally, wood is dried to that equilibrium moisture content as will later (in service) be attained by the wood. Thus, further dimensional change will be kept to a minimum.

Dried timber is lighter, and stronger than green timber in most strength properties, and may be easier to impregnate. Dry wood also generally works, machines, finishes and glues better than green timber. Paints and finishes also last longer Larger rounds may never be sufficiently dried before use, or may take an impractical or uneconomical period of time to dry.

A further advantage of using 4, 5, 6, or 7 small diameter (40 mm to 60 mm) rounds to form composite structural members is that such small rounds may be used in manufacture even with relatively high moisture content. Without wishing to be limited by theory, it is proposed that the shrinking stresses in smaller rounds is far less than large rounds, and so composite members formed from smaller rounds may be dried after manufacture. This provides a time advantage in manufacture, given that is possible to manufacture the members without pre-drying the rounds. Alternatively, the manufacturer is not forced to keep a stock of pre-dried rounds.

Yet a further advantage of the use of multiple rounds (including 4, 5, 6, or 7 rounds) is that any imperfection in a region of a round (that may cause a structural weakness) is at least partially compensated for by the wood in rounds directly above and/or below the imperfection. While each round in a composite member may have an area of weakness, the likelihood of two rounds having a weakness at the same point is very unlikely.

The timber rounds used in the context of the present invention have diameters of less than those disclosed in Applicant's prior international patent application PCT/AU2009/001453. In an embodiment of the structural beam one, two or three round(s) has/have a diameter of less than about 125 mm. In another embodiment one, two or three round(s) has/have a diameter of less than or less than about 100 mm. In yet a further embodiment one, two or three round(s) has/have a diameter of less than or about 75 mm.

It has been surprisingly found that even smaller diameter rounds (of between about 40 mm to about 60 mm, such as peeler cores) may be used to fabricate useful timber structural members. Where rounds of such small diameter are used, it is typical that 4, 5, 6, or 7 rounds are required to achieve a composite member of useful strength. The resultant composite structural members may be used as very low cost joists. Such structural members may have widths as low as 40 mm.

Applicant has further found that such joists can be further strengthened (where necessary) by placing a two or more members side-by-side (such that each similar element abuts lengthwise) and cross laminating with dowel and adhesive and/or gusset plates and the like to provide a stronger multi-joist with two or more members.

Typically, the diameters of the rounds are substantially equal.

The timbers used for the first and/or second and/or third timber rounds may be so-called "true round sections", "true rounds". Timber rounds are described in Section 6 of Australian Standard 1720, and are typically produced from softwood trees grown commercially as renewable forest plantation timber. These timbers are typically fast growing, easily harvested, and have a low natural defect rate.

Various species of timber are suitable to form the true rounds, particularly those types of species that tend to have a relatively constant diameter for a considerable portion of their length to minimise waste during the trimming and circularising processes. Plantation pine materials, such as slashpine or Carribaea hybrids, tend to form suitable true rounds. Other materials that might be considered include Douglas fir, and various eucalypt species.

True rounds are particularly strong since the natural strength of the timber fibres is not disrupted by sawing or other treatment. The integrity of the round is maintained, and the trimming process required to circularise the round does not greatly affect the overall strength of the round. The natural characteristics of timber are that the central core or pith of the round is relatively soft and has low structural strength. The periphery of the timber, on the other hand, is much harder and the timber fibres are able to carry a high tensile load. Also, this hard outer layer is more resistant to water absorption and attack by insects, and thus by keeping the outer circumference of the timber largely intact in the process of preparing a true round, the structural integrity of the timber is maintained The rounds in some forms of the invention do not strictly conform to Australian Standard 1720, and may be of a smaller diameter such that the Standard is not satisfied. However, by the fastening of at least three rounds together a required load bearing capacity may be nevertheless attained.

In some embodiments, the rounds are "peeler cores". As is understood by the skilled person, a peeler core is a round pressure treated post. A peeler core has been turned in a milling machine to the point that substantially all the soft wood has been removed (for plywood manufacturing), leaving the hardwood core which is typically dense and inflexible. The milling process peels off the bark, cambium layer, sapwood, and even some of the heartwood to make veneer panels. This leaves no sapwood on the post.

The hardwood core of a peeler core does not absorb the pressure treatment and preservatives as well as the softwood resulting in an inferior post that will typically not last as long as a post with treated softwood on the exterior.

Applicant has discovered an economically and technically viable use for peeler cores in that the cores may be used in a composite timber product such as that disclosed herein. The use of multiple peeler cores (and even those with a diameter down to about 70, 60, 50 or 40 mm) can produce a member which is useful in construction and yet is highly cost-effective.

As discussed in the Background section, peeler cores are essentially a waste product of forestry, having little value in the market. In one embodiment, the present invention is directed to timber structural members that are comprised of peeler cores only.

Given the low diameters of peeler cores, it will be appreciated that a greater number of rounds may be required to achieve any desired structural property. For example, while a structural member composed only of larger diameter rounds may only require 2 or 3 rounds, the use of peeler cores may require 4, 5, 6, 7 or 8 rounds to achieve a useful result.

Accordingly, in a further aspect the present invention provides a structural member comprising: a first timber round having a first cooperating surface extending longitudinally along the length thereof, a second timber round having a second and a third cooperating surfaces extending longitudinally along the length thereof, and a third timber round having fourth and fifth cooperating surfaces, and fourth timber round having a sixth cooperating surface extending longitudinally along the length thereof wherein, the first cooperating surface is shaped to cooperate with the second cooperating surface, and the third cooperating surface is shaped to cooperate with the fourth cooperating surface, the first, second and third timber rounds are secured together to form a structurally integral unit in which the first cooperating surface is in contact with the second cooperating surface, and the third cooperating surface is in contact with the fourth cooperating surface, and the first, second and third timber rounds are substantially parallel to each other, and wherein the first, second and third timber rounds are secured to each other by a plurality of fasteners spaced along the length of the member, the plurality of fasteners comprising fasteners provided at both acute and obtuse angles from a longitudinal axis of the structural member, the fasteners extending through the first, second and third timber rounds.

In one embodiment, the first, second, third and fourth timber rounds are all peeler cores, and optionally peeler cores having a diameter of between about 40 mm and about 60 mm Without wishing to be limited by theory in any way, it is proposed that the use a higher number of rounds results in a structural member of a strength greater than simply the additive values of each individual round. Such members may be stiffer and less liable to deform or deflect than would be otherwise expected. It is thought the each added round provides a further shear face, with each added shear face provided an incremental advantage.

In one embodiment, the plurality of fasteners includes adjacent fasteners. The use of smaller diameter rounds requires special consideration of the acute and obtuse angles at which the fasteners are provided in order to, in some circumstances, provide a required load bearing capacity. Advantage is found where the acute angle is equal to or greater than about 20°, 25°, 30°, 35°, 40°, 45°, 50°, 55°, 60°, or 65°. The acute angle may be less than about 70°, 65°, 60°, 55°, 50°, 45°, 40°, 35°, 30°, or 25°. In one embodiment the acute angle is about 45°. The skilled person understands that the angles specified herein are not required to be precisely those cited numerically. Indeed, there is typically no requirement for great accuracy in the art with variations of 5% in these angles generally being tolerated. However, where required by engineering specifications to provide for a predetermined load bearing capacity, a lower tolerance may be provided for.

Typically the obtuse angle is calculated by the addition of 90° to the acute angle. In some embodiments, the obtuse angle is equal to or greater than about 110°, 115°, 120°, 125°, 130°, 135°, 140°, 145°, 150°, or 155°. The obtuse angle may be less than about 160°, 155°, 150°, 145°, 140°, 135°, 130°, 125°, 120°, or 115°. In one embodiment, the obtuse angle is about 135°.

In some embodiments (and including embodiments where the rounds are peeler cores, and where 4, 5, 6, 7, or 8 peeler cores are used in a structural member) acute fastener angles of between 25 degrees and 35 degrees, and particularly about 30 degrees are used. An optimum angle of 30 degrees (irrespective of member height, width or pin size etc) is proposed. Maximum advantage may be found in embodiments where the maximum adhesive coverage of the longest fastener possible for that member (at maximum length, that being the hypotenuse length) which all occurs at about 30 degrees.

The cooperating surfaces of the timber rounds may be of any configuration deemed suitable by the skilled artisan, however the surfaces are typically substantially flat. Given the use of three rounds in the present structural members, the second (central) round may have two cooperating surfaces: a first cooperating surface configured to abut the first round and a second cooperating surface to abut the third round.

The rounds may be machined or otherwise treated to remove a minor segment along the length of the round in order to provide a flattened cooperating surface. The proportion of the flattened cooperating surface to the diameter of the round is selected to provide the structural member being manufactured with a suitably sized cross section. A suitable minor segment size for removal may be a segment with a depth of approximately 0.2 times the diameter of the round—i.e. for a 75 mm round a minor segment with a depth of approximately 15 mm is removed. The proportions may be altered depending on the particular structural application that may be required.

Applicant has found that reducing cooperating surface area width leads to an increase in the crushing effect referred to supra if below a critical surface area. Furthermore, the advantage of the shear face effect discussed supra diminishes.

In light of the above, it will be appreciated that advantage may be gained where the number of rounds is increased to sacrifice bearing surface.

In some embodiments, the structural member has a lower width for the shear faces for the internal rounds (for example, rounds 2, 3, 4, and 5, of a 6 round member), this allowing a greater height. As one example, for a 50 mm diameter member, a shear zone 20 mm width provides a height of 44 mm. In another example, a shear zone of 40 mm provides a height of 30 mm.

For some applications, account may be taken of the height to width ratio of the composite structural member. It is preferred for some applications that the height to width ratio does not exceed about 5:1. By way of example, a 40 mm wide member made from 40 mm diameter rounds should not exceed 200 mm in height.

Prior to joining the machined rounds to create the structural member, the rounds may be treated with a preservative to provide service life protection. Varying degrees of protection can be imparted dependent upon the intended application of the structural member. A suitable preservative may be provided by employing the process known as Ammoniacal Copper Quaternary (ACQ) which is Chromium and Arsenic free.

Once provided with cooperating bearing surfaces (as described above) the rounds are secured together. The rounds are firstly brought together using a jig, and the structural member is laminated along the cooperating interfaces.

The first second and third rounds may abut in any configuration deemed suitable by the skilled artisan, including in a stacked configuration i.e. the first directly over the second, and the second directly over the third). In that configuration, the first and third rounds have a single cooperating surface each, and the second round has two cooperating surfaces, as described supra.

Alternatively, the rounds may be configured such that each round abuts two other rounds, such that each round has two cooperating surfaces.

Where the cooperating surfaces are substantially flat, at least two or three of the surfaces are substantially parallel. Typically all substantially flat cooperating surfaces are parallel.

The present timber beams comprises fasteners, which may be inserted into holes drilled through the structural member, for example by drilling through the three rounds. Fasteners are then inserted into the holes and are fixed in place, optionally using an adhesive bonding material.

The skilled person will be capable of selecting an appropriate fastener type, and may choose from pins, dowels, rods, or bolts. In one embodiment, the fasteners are deformed reinforcement bars of the type typically used in the concrete construction industry.

The fasteners may be inserted by any method deemed appropriate by the skilled artisan, and may be manually rotated into the final position, or in rotated with the assistance of an electric drill or similar device.

Alternative fasteners include, for example, hot dipped galvanised deformed or Y-bar dowels, or any other dowel/rod/fastener with suitable strength properties for the requirements of the structural member and environmental conditions to which the structural member will be exposed. For example, and depending upon the proposed application of the structural member, fasteners of varying corrosion protection can be deployed.

The positions and angles of the holes may be selected to ensure that once fasteners have been secured in place sufficient bonding occurs to ensure true composite action of the structural member.

The diameters of the holes and the dimensions of the fasteners may be selected in accordance with the intended application of the structural member. The holes may be sized to allow the fasteners to fit with sufficient clearance as dictated by the performance properties of the adhesive bonding material being used. The diameter of the holes may be from about 0.5 mm to about 4 mm larger than the greatest diameter of the fastener to be inserted therein.

The skilled person understands that measurements used in the nomenclature of deformed bars may not properly reflect the true dimensions of the bar, and that independent measurements should be made before deciding a diameter for the receiving hole. For example, what is commonly termed a "16 mm" bar is typically 17.5 mm at the widest diameter, and so where a 1 mm gap is required between the fastener and the hole wall, a hole of 19.5 mm diameter is used.

In one embodiment the holes and fasteners are of a relatively small diameter. Fasteners equal to or less than about 12 mm or about 10 mm in diameter may be used. For example, an N10 deformed bar (Mesh and Bar Pty Ltd, Australia) may be used. Relatively small diameter holes require lesser amounts of glue (where used), thereby increasing the cost-effectiveness of the present beams.

When securing the fasteners in the holes a preformed annular centring ring may be used to ensure the fastener may be centrally located in the hole. The centring ring (described below) allows the adhesive to flow through the ring into the hole to ensure full encapsulation of the fastener by the adhesive. The adhesive is injected around the fastener from one end of the hole, the other end of the hole allowing air to escape during the injection process. This ensures uniform distribution of the adhesive around the dowel within the hole. The adhesive may be injected using, for example, a trigger cartridge gun or pneumatic cartridge gun. A washer (described below) may also be disposed inside the hole across the interface between two rounds to prevent glue from escaping at the interface.

Once the members have been located in a jig the fasteners are inserted into holes and glue injection takes place. The rounds and are held in place whilst the adhesive achieves initial curing. This typically occurs within 4 hours but is dependent upon a number of variables including temperature, moisture content of the timber and glue formulation. If a cambered structural member is required this can be achieved by applying the camber to the rounds and in the forming jig. Applying an initial set to the rounds while the adhesive cures will ensure that the pre-camber is maintained in the structural member.

The adhesive bonding material may, for example, comprise a two component epoxy material or in some applications a single phase epoxy may be used. Ideally the epoxy completely encases the fastener, thereby providing a barrier to corrosion of the fastener along its entire length. Specifically, a suitable adhesive is a structural epoxy resin such as waterproof thixotropic solvent free epoxy resin. The adhesive bonding material provides the additional benefit of providing corrosion protection to the embedded fasteners.

The fasteners may laced through the structural member to provide for a structural member which exhibits restraint to longitudinal cracking which is typical of high load failure. The precise number, type and angle of insertion of the fasteners will depend on the intended application of the structural member.

The fasteners may be inserted in a repeating V-pattern to provide a trussing effect (see FIG. 2, for example), being the ability of the fasteners (in their diagonal configuration) to transfer imposed loads from the bearing surfaces to the outer connection nodes thus reducing the amount of stress borne by the wood fibres alone.

In some embodiments, the timber structural member comprises more than one series of fasteners. For example, where a first series of fasteners are aligned along the central axis of the member, a second series may be provided to the right, and a third series provided to the left (when considered in plan view). The second and third series of fasteners may be inserted in a repeating V-pattern (and at angles described elsewhere herein for the central series of fasteners). In one embodiment, the arrangement of fasteners in the second and third series are similar, or substantially identical, with respect to spacing between fasteners, and/or the angle at which they are inserted, and/or their absolute positions within the timber structural member. These parameters for the second and third series of fasteners may be different to those for the first, central series of fasteners. In some embodiments, at least two of the series of three are staggered with respect to each other.

The first, second and third series of fasteners are typically disposed along parallel lines. The offset between the first series and the second series, and the first series and third series of fasteners is typically substantially equal. The offset size may be affected by the size of the holes (larger holes generally dictating a larger offset), and also the width of the timber structural member (wider members allowing for greater spacing between the series of fasteners). The offset may be greater than about 12 mm, 15 mm, 18 mm, 21 mm, 24 mm, 27 mm or 30 mm.

The use of multiple series of fasteners disposed longitudinally along the timber structural member is typically provided for with timber structural members of width of greater than about 40 mm, 50 mm, 75 mm, 100 mm, 125 mm, 150 mm, 175 mm or 200 mm. Broader members may be suited to applications where it is necessary to spread load across a larger bearing surface, for example where the timber structural member is used as a bearing face for flooring (such as plywood). In such situations, a bearing surface of the beam may be substantially flat to allow close cooperation with a floor board or other subfloor structure.

Fasteners provided at 90° (i.e. perpendicular to the longitudinal axis of the structural member) would not provide any trussing effect and would result in very short glue bond lengths per fastener (approximately 2 diameters per pin).

The distance between the ends of adjacent fasteners on the same edge of the structural member may be about ⅓ of the cross section of the structural member.

Depending on the intended application of the structural member, either one or both ends of the rounds of the structural member may be provided with axial bores and/or radial cuts to facilitate connection of the structural member to another member or structure.

The axial bores allow for dowel type end grain connections to be made at each end of the structural member. The axial bores are machined into the end (or ends) of the rounds to a predetermined depth. Each bore is dimensioned to receive a steel dowel (or similar) as shown.

As per insertion of the fasteners as described above, the axial bore will generally be of slightly larger diameter than the dowel to allow an adhesive bonding material to be injected and fully surround the dowel, thereby ensuring a high strength bonded connection between the dowel and the rounds. The adhesive may be injected using, for example, a trigger cartridge gun or pneumatic cartridge gun.

To ensure that the dowel is centred within the bore, an annular preformed centring ring may be used. The centring ring (typically an "0" ring) may include a central aperture having a diameter substantially the same (or slightly larger) than the dowel to be used. The circumference of the centring ring is provided with a number of lugs which are sized/positioned to engage with the edges of the bore. In use, the centring rings are placed and affixed along the dowel with at least one centring ring for each member that the dowel will need to pass through.

The dowel is then inserted into the bore through the central aperture of the centring ring. The centring ring ensures the dowel is centrally located within the bore and allows adhesive to be injected into the bore between the edges of the bore and the lugs. The centring ring may be made from plastic, metal, or a composite of materials.

A washer may be used across the interface(s) between the structural member 100 and any other members it is attached to, thereby limiting leakage of glue into the joints between members. The washer may comprise an annulus that has a central aperture, the inner diameter of the annulus being substantially the same as the dowel, and the outer diameter of the annulus being substantially the same as a rebate that is bored axially aligned with the bore. The length of the washer can be between 2 and 10 mm, and the length of the rebate therefore needs to be at least sufficient to accommodate the washer, with the washer crossing from one member, across the interface between them, into another member. The inner surface of the annulus has a number of lugs which are sized and positioned to hold and centre the inserted dowel in the bore (or hole).

When connecting the structural member to another member or round (or when connecting the three rounds of the structural member together), the process generally entails drilling the required holes in the relevant members or rounds, inserting the dowel/fastener (either with or without using a centring ring), inserting the washers across the joints, and then injecting the glue from an exposed end of a hole through the members or rounds.

Alternatively, a dowel/fastener-washer combination can be inserted simultaneously. If required, the glue may be injected with the use of a bleeder hole. Once the glue has been injected, the dowel/fastener will be encapsulated by glue. The ends of the dowels/fasteners can be protected from coming into contact with the timber by using an end cap or dipping the ends of the dowel in a compound such as liquid rubber so as to create a cap with a diameter substantially that of the bore or slightly less.

With regard to the fasteners, the end cap may also serve to centre the fastener in the bore, in which case the centring devices as discussed above may not be required. The end caps also prevent the ends of the fasteners from being exposed to the environment and serve to smooth out/cushion the ends of the fasteners, thereby dealing with a potential breaking point.

In some embodiments, the fasteners may be disposed to ensure that no portion of a fastener extends outside the member. Many building standards have provisions for fire proofing timber components, including a requirement that metal fasteners (as good thermal conductors) are appropriately insulated from the environment. Thus, the fasteners may be disposed such that at least a certain minimum depth of wood (for example at least 20 mm) exists between the end of a fastener and the nearest edge of the member. Alternatively, plugs or end caps may achieve the same level of insulation.

In addition to allowing the securing the dowels, the axial bores may also remove the central (and usually weakest) part of the rounds. This, in turn, provides enhanced strength/structural integrity to the structural member as a whole.

Once the dowels are secured in the structural member their free ends can be used to connect the structural member to an additional member/structure. Load forces experienced by such a combined structure are then transmitted axially through the rounds of the structural member. This serves to add to the strength of the combined structure.

Further, by housing the connecting dowels within the rounds the dowels are largely protected and insulated from fire. Other known joining systems make use of connectors (e.g. dowels, pins, nails, bolts, plates etc) which are externally fitted. In the event of a fire, such externally fitted connectors have been found to transfer heat into the timber of the joist resulting in an undesirable increase in the destabilisation of joints. It is theorised this increase in destabilisation is caused by the connector becoming so hot that the timber in the hole is charred and shrinks away, thereby creating dynamic stresses in now moving members.

By providing internal dowel connectors this problem is avoided, and the fire rating of the structural member is dependent on the rounds. It is further noted that the rounds and used in the present invention are, in their own right, less combustible than sawn timber.

In use, it is envisaged that the free ends of the dowels will be inserted into a bore in the member/structure which is being secured to the structural member. A similar bonding arrangement to that described above is used to ensure that both ends of the dowel are properly anchored in their respective bores.

By providing for connection to/with the structural member by a pair of axial dowels twisting of the structural member as load is applied is prevented. If required, both ends of the structural member can be secured in this fashion, in which case four high strength axial dowel connections are used to secure the member in position.

Where the structural member is to be connected to a circular pole or the like (such as a further true round), the ends of the rounds may further be provided with radial cuts. Although the term "radial" is used it will be appreciated that the cut need not be precisely circular and could have a more general scalloped or concave shape. The radius of curvature, or the shape, of the cut is selected to mirror the diameter of a circular pole or generally concave shape of another member to which the structural member may be connected. This provides for a neat and structurally sound connection with the circular pole or other member.

The radial cuts may be machined into the rounds using, for example, a customised large bore hole saw machine. Further, the angle of the axes of the radial cuts may be selected to allow for connection with another member at any orientation.

In a further aspect the present invention provides methods for producing the timber structural members described herein.

The timber structural members described may be used in any application for which they are deemed suitable by the skilled artisan. One particular application is as a composite joist formed from the structural member of this invention exhibit numerous benefits over traditional single member sections. For example, the structural member may provide the appropriate depth to width ratio required for use as a beam: the ratio is approximately 2 to 1, making it well suited as a bending member. The members are economically manufactured by taking advantage of low cost raw materials, waste material from felling and milling and also less expensive softwood species.

In some embodiment, the timber structural member may have a construction such that for maximum load bearing capacity the member must be disposed with one face directed toward a load vector, while the opposite face points away from the load vector. As an example, where the fasteners are arranged in a V-pattern, the timber structural member should be installed such that the "V" is upright. The centre of a beam is its weakest point, and where a 'V' is disposed toward the centre of a beam the asymmetry becomes particularly evident. At this point, strength is not compromised where the "V' is orientated upright, however if the beam is turned through 180 degrees (such that the "V" is inverted) there is a significant distance between the exit points of fasteners pins at the lower face of the beam (where the strain/deflection/tension is greatest) leading to a vulnerability in the beam. Accordingly, some embodiments of the invention comprise indicia indicating the preferred or required orientation of the timber structural member.

The applications for the structural member of the present invention are the same as that of any other beam or beam/column material, including typical domestic construction. The structural member is dimensionally suited to higher load applications and can effectively replace larger sawn sections in domestic construction and laminated veneer sections in commercial constructions.

The applications for the structural member include, by way of non-limiting example only, floor members such as bearers or joists, wall framing members such as lintels and heavy duty studs, roof framing members such as rafters or hanging/strutting beams, portal frame members such as columns, rafters or bottom chords, and beam/column members including piers and acoustic barrier posts.

Some embodiments of the present invention are well suited to shorter span applications, such as spans of around 3 meters or less. However, where longer spans are required, there exists the option of joining multiple members (in a lengthwise manner) to provide the required length. The multiple members may be joined in any manner deemed suitable by the skilled artisan, and may be mitred, dovetailed, finger-jointed, butt-ended or dowel pinned. A preferred form of dowel pinning is described in PCT/AU2009/001453.

The present structural members may also be useful as studs, which are generally of shorter length than a joist and of decreased thickness. Studs (and indeed structural members for any other applications) may be formed by rounds of mixed sizes, for example 70/60/70 mm or 80/70/80 mm.

As briefly discussed supra, the present structural members may be useful as joists. Such joists may be formed into modules of 2.4 m by 2.4 m to create a very strong modular flooring system where the outside or perimeter joists of a module co-operate with the adjacent and abutting edge of a joist in a similar module by cross pinning and laminating and through pinning and laminating. In this case, modules of 2.4 m by 2.4 m can abut all the way around to another module in an additive manner except for the outside of the shape which can also benefit by laminating a further joist to it. Effectively, this new cross pinned and laminated double member joist is capable of acting as a bearer when supported at every 2.4 m and by adding an extra joist this system is reduced by that 2.4 m length of more expensive (but stronger) bearer. A further advantage is that modules can be prefabricated and delivered to site with considerable cost and time savings Optimum beam depth to span ratios generally stay true for increasing element numbers in a beam and when that beam is used as a joist it can still produce the lowest beam mass per meter per unit of load carried. Such Joists may comprise 5×50 mm rounds to provide a joist of 215 mm H, or 6×50 mm rounds to provide a joist or 210 mm H, or even a 7×40 mm rounds to provide a joist of 180 mm H.

The skilled person understands that by performing a similar analysis on a range of conformations it will be possible to effectively optimise joists based upon resource availability and beam function.

In some embodiments, the multiple members are not physically joined, and simply abut each other in situ.

Embodiments comprising multiple members provide further economic and/or environmental advantages given that wood that may have ordinarily been discarded due to insufficient diameter and insufficient length may be utilised to produce a high value beam.

The various elements can also be joined to form a range of connections such as truss nodes (knee and ridge connections).

Rounds may be joined end-to-end in order to fabricate members of extended span. The joins may be effected by the use of a connecting member (including a dowel, but preferably a planar member such as a key) glued into a recess straddling the abutting end faces of two timber rounds. The recess is typically dimensioned so as to ensure a snug fit with the connecting member, and allowing for adhesive (if required). Any of the adhesives disclosed elsewhere herein may be used with regard to the connecting members.

In terms of thickness, the recess may have a depth of greater than about 5%, 10%, 20%, 30%, 40% 50% or 60% the depth of the round in which it is disposed.

In terms of thickness, the recess may have a depth of less than about 5%, 10%, 20%, 30%, 40%, 50%, or 60% the depth of the round in which it is disposed.

The recesses may be formed on a non-end face of the abutting timber rounds (including a cooperating surface of a round).

The end faces forming the joins are typically staggered such that joins do not overlie or underlie each other. It will be appreciated that not all joins must be staggered in this way.

Typically, the connecting member is substantially centred on the longitudinal axis of the member. In embodiments where the fasteners are also disposed along the central longitudinal axis, connecting members are disposed between the fasteners. Preferably, the connecting member is disposed substantially mid-way between two fasteners.

In one embodiment, the continuous recess extends into a non-end face of an underlying or overlying timber round such that the connecting member is seated in the recess thereby straddling (i) the abutting end faces of the two timber rounds, and (ii) the interface between the abutting two timber rounds and the underlying or overlying timber round. Thus, the connecting member may laminate 3 timber rounds together (2 end jointed rounds, with the cooperating surface of an overlying or underlying round). These connecting members act by lamination in 3 planes to complement and add to the composite integrity of the overall member. The connecting members may be continual (thereby improving economy) and may only be used in areas of least bending moment. The fastener geometry may be configured such that tongue in groove joints are avoided.

The connecting member may be configured so as to resist the vertical shear bending forces along the vertical plane centroid of the member's length with its length surfaces (L×H)—these forces being in the 'y' plane.

The connecting member may be configured to also resist the horizontal shear bending forces along and at 90 degrees to the vertical plane centroid of the member at its top and bottom surfaces (L×W)—these forces being in the 'x' plane The connecting member may be configured to also resist the compression forces along the vertical plane centroid of the member's length with its width (W×H) end surfaces—these forces being in the 'z' plane.

It is preferred that wider connecting members acting in the 'z' plane are used, however for reasons of economy more narrow connecting members may be used. More narrow members act predominantly in the 'x' and 'y' planes along the vertical plane centroid of the member's length in concert with the fasteners.

Resistance to shear, compression and other forces may be afforded by the selection of an appropriate material for the connecting member. For reasons of economy, the connecting member may be fabricated from wood (and even a waste wood product). However connecting members fabricated from an artificial polymer (such as a plastic), or a metal are anticipated to be useful.

Because ply peeler cores are typically no longer than 2400 mm, the present extended span members are a very cost effective means of utilizing peeler core off-cuts, whilst lengthening the span. Global ply industries produce many smaller sizes as well (generally from 800 mm min with 300-400 mm increments up to 2600 mm) which commercially typically results in 2400 mm lengths. The present invention provides makes use of not only the immense global wastage of peeler cores, but also even the shorter lengths and off-cuts of this waste product.

Such extended span members allow the use of previously low value elements (such as peeler cores, and even relatively short peeler cores) which are waste products from the production of high value commercial plywood products. The ability to combine low value products into longer spans thereby providing higher value, longer span products is a significant advantage of these embodiments.

The rounds may be laminated in 2 planes, one being the horizontal plane by the stacking of multiple rounds on top of each other, as well as by the vertical second plane whereby the fasteners are aligned along the centroid.

The connecting members act as a partial length tongue in groove system, but preferably are also laminated in both planes depending on height length and width to gain the maximum lamination. These connecting members may be placed so as to improve beam strength by avoiding stress areas of high bending moment. By these end jointing methods, integrity to the overall member is provided by the compression afforded by the fasteners.

In some embodiments, the connecting members allow the use of a large number of timber rounds to compose a single structural member. Members comprising greater than 15, 20, 25, 30, 35, 40, 45 or 50 rounds may be used. The connecting members allow the stacking of very large numbers of rounds and/or the abutment of very large numbers of rounds end-to-end. In these embodiments (and indeed other embodiments) the connecting members may be shaped, dimensioned, fabricated or otherwise configured so as to augment the overall strength of the structural member.

Moreover, the use of large numbers of rounds with connecting members may overcome any weakness inherent in the rounds such as that due to knots, sap pockets, the species of wood, the maturity of the wood, the softness of the wood etc. Any weakness may be dispersed over the structural member or diminished by virtue of proximal areas of wood which fortify the area about the weakness.

DETAILED DESCRIPTION OF PREFERRED EMBODIMENTS OF THE INVENTION

Referring to FIG. 1 there is shown (in perspective view) a timber structural member 100 formed from three rounds 102, 104 and 106. The rounds 102, 104 and 106 are stacked, with round 102 having a first cooperating surface (not shown), round 104 having a second cooperating surface (not shown) and a third cooperating surface (not shown), round 106 having a fourth cooperating surface (not shown). The interface between the cooperating surfaces of the rounds 102 and 104 is shown at 152. The interface between the cooperating surfaces of the rounds 104 and 106 is shown at 154.

The rounds 102, 104 and 106 are drilled with alternating holes at an acute angle 108, and holes at an obtuse angle 110.

Inserted into each of the acute 108 and obtuse holes 110 are fasteners 112 which are dowels.

The rounds 102, 104 and 106 of the structural member 100 are provided with axial bores 160 and radial cuts 162 to facilitate connection of the structural member 100 to another member or structure.

The axial bores 160 allow for dowel type end grain connections to be made at each end of the structural member 100. The axial bores 160 are machined into the ends of the rounds 102, 104 and 106 to a predetermined depth. Each bore 160 is dimensioned to receive a steel dowel 156 as shown, which in this embodiment is a deformed reinforcement bar, similar to the dowel 112 used for cross-doweling between the rounds 102, 104 and 106.

Figure 2B:
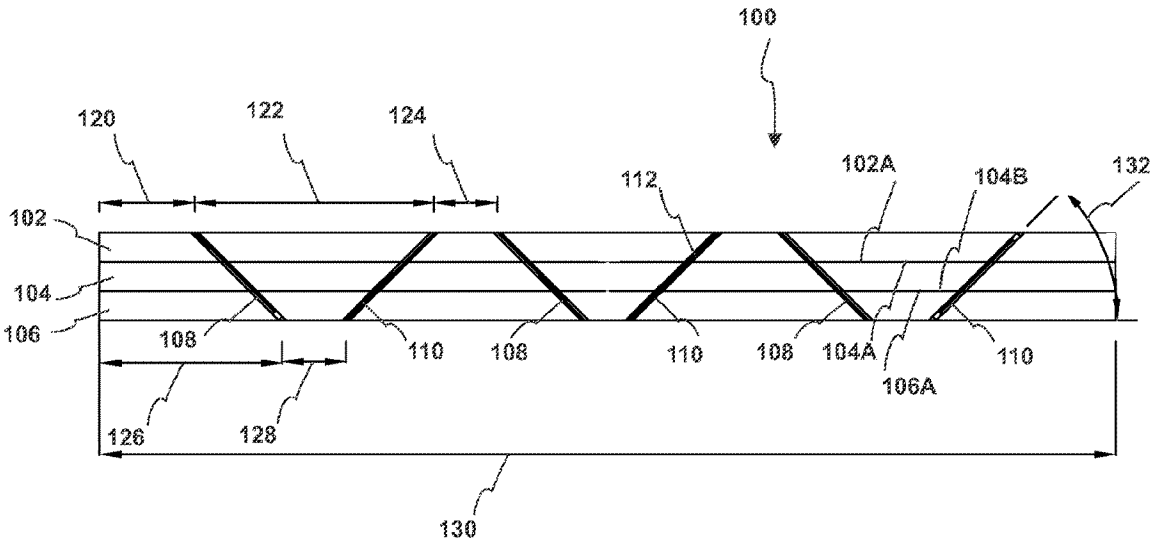
FIG. 2 shows a diagrammatic view (not to scale) of a structural member in accordance with an embodiment of the present invention. The member is composed of three sub-members which are joined by alternating obtuse and acute fasteners.
Figure 2A:
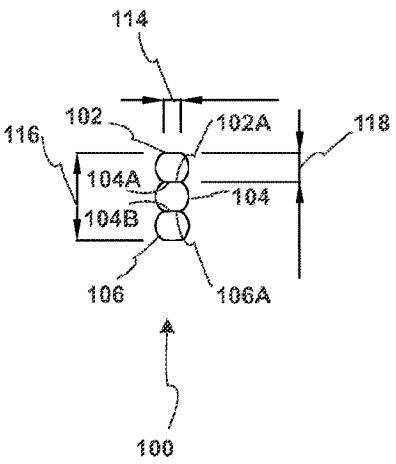

Referring to FIG. 2 there is shown in diagrammatic form (lateral view; with features numbered in general accordance with FIG. 1), a timber structural member 100 formed from three rounds 102, 104 and 106. Panel A shows an end view, while Panel B is a lateral view. The rounds 102, 104 and 106 are stacked, with round 102 having a first cooperating surface 102A, round 104 having a second cooperating surface 104A and a third cooperating surface 104B, round 106 having a fourth cooperating surface 106A. All cooperating surfaces 102A, 104A, 104B, and 106A are flat and formed by the removal of a longitudinal portion of each round, this being more clearly shown in the end view of Panel A.

The rounds 102, 104 and 106 are drilled with alternating holes at an acute angle 108, and holes at an obtuse angle 110. The acute angle in this embodiment is 45°, and the obtuse angle is 135°, as measured by reference to the longitudinal axis of the member 100. It will be noted that the acute 108 and obtuse 110 drilled holes form a mirror image, such that the obtuse holes 110 can be seen to form an angle of 45° 132 with the lower surface of round 106, as does the acute drilled holes 110. The holes are disposed along the vertical plane running along the central longitudinal axis of the structural member.

Inserted into each of the acute 108 and obtuse holes 110 are fasteners 112 which are dowels.

The diagram of FIG. 2 is not drawn to scale, with the embodiment shown having the following exemplary measurements:

| | |
|---|---|
| 114 | 40 mm |
| 116 | 208 mm |
| 118 | 69 mm |
| 120 | 225 mm |
| 122 | 565 mm |
| 124 | 150 mm |
| 126 | 432 mm |
| 128 | 150 mm |
| 130 | 2400 mm |

Figure 3B:
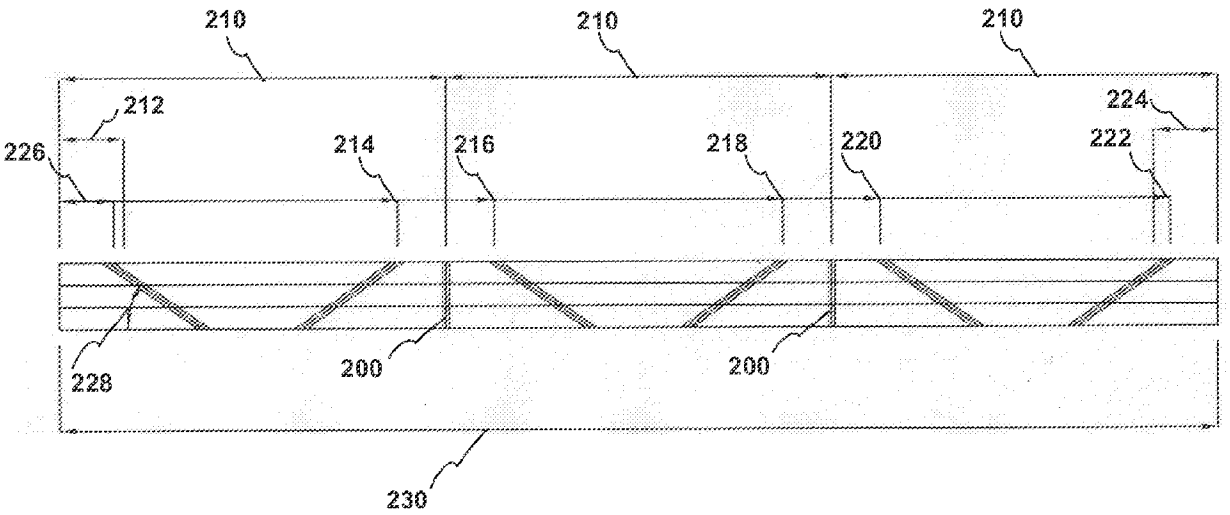
FIG. 3 shows a diagrammatic view (not to scale) of a structural member in accordance with an embodiment of the present invention. The member is composed of three sub-members which are joined by alternating obtuse and acute fasteners, and also interposed fasteners.

The diagram of FIG. 3 is not drawn to scale, with the components being generally as indicated in FIG. 2. Different to FIG. 2, the embodiment of FIG. 3 includes interposed holes 200 disposed as shown. The holes 200 are aligned with the acutely and obtusely angled holes, being disposed along the vertical plane running along the central longitudinal axis of the structural member, and are angled orthogonally with respect to the flat cooperating surfaces. The interposed holes 200 have fasteners inserted therein (not shown). The embodiment of FIG. 3 has the following exemplary measurements:

| | |
|---|---|
| 210 | 1200 mm |
| 212 | 200 mm |
| 214 | 1050 mm |
| 216 | 1350 mm |
| 218 | 2250 mm |
| 220 | 2520 mm |
| 222 | 3450 mm |
| 224 | 200 mm |
| 226 | 168 mm |
| 228 | 35 degrees |
| 230 | 3600 mm |
| 232 | 40 mm |
| 234 | 69 mm |
| 236 | 80 mm |
| 238 | 208 mm |

The use of interposed holes (with fasteners) provides a substantial advantage by reinforcing against deflection at points along the structural beam.

The interposed holes and fasteners may be disposed at regular, semi-regular or irregular points along the beam. Generally the interposed holes and fasteners are inserted at an angle bisecting that made by adjacent obtuse and acute holes. Typically the interposed holes and fasteners are inserted at an angle orthogonal to flat cooperating surfaces of the beam.

Figure 5A:
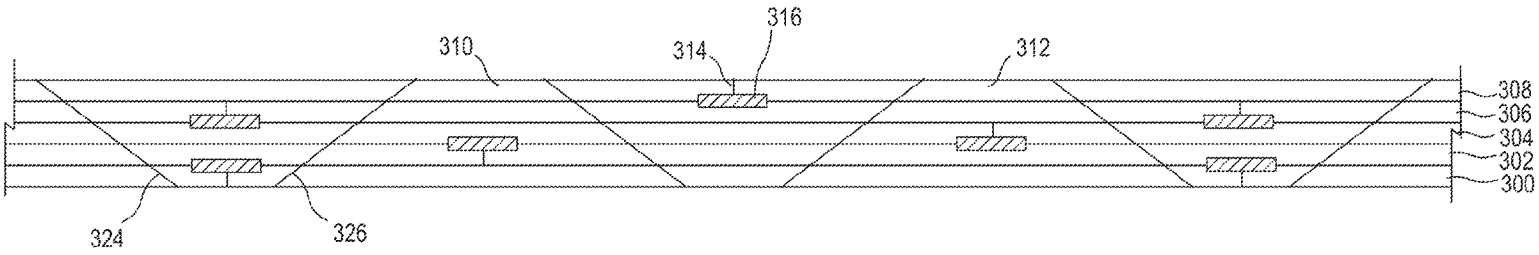
FIG. 5A shows a diagrammatic lateral view (not to scale) of an extended span structural member in accordance with an embodiment of the invention. The structural member is comprised of five peeler cores laminated together with a series of keys.

The diagram of FIG. 5A shows an extended span timber structural member comprising connecting members. This means of joining together multiple, relatively short peeler cores together to form useful longer timber structural member allows the exploitation of waste products as described elsewhere herein.

The structural member of this preferred embodiment comprises timber rounds stacked at 5 levels (300, 302, 304, 306, 308). Each level is formed from multiple peeler cores. For example, at the uppermost level 308 two peeler cores 310, 312 are shown, the cores abutting at the join 314. Other joins are shown at each level, but not marked.

A series of connecting members (one of which is marked 316) are incorporated to the member, and are glued into recesses formed in the peeler cores. In this embodiment, the connecting members are keys of 19 mm ply, 200 mm in length and 40 mm in height, and have a rectangular prismic form.

Figure 5B:
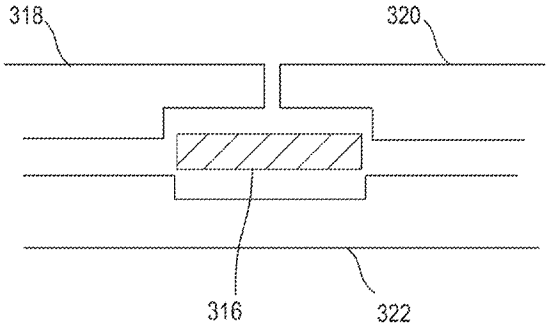
FIG. 5B is an exploded diagrammatic view of the dashed region of FIG. 5A.

Arrangement and configuration of the recesses about a single key is shown more clearly in the exploded view of FIG. 5B which shows a key 316 in engagement with a first peeler core 318, a second peeler core 320 and a third peeler core 322.

The structural member incorporates a series of acute and obtuse fasteners (two marked as 324, 326) disposed along the longitudinal axis as shown. The fasteners are metal pins, of diameter 16 mm in this embodiment. It will be appreciated that other materials and diameters may be used.

Figure 6:
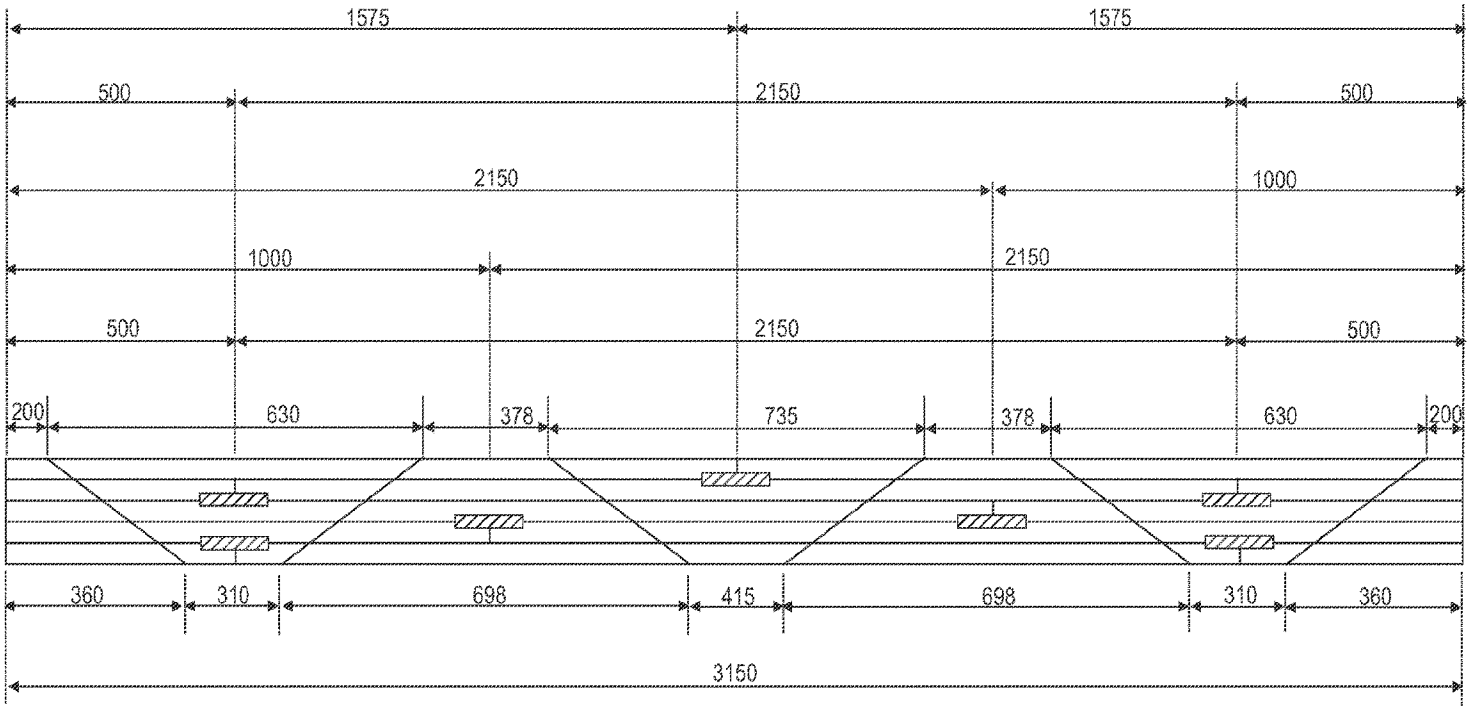
FIG. 6 shows a diagrammatic lateral view (not to scale) of the structural member of 5A, annotated to show dimensions (in mm).

In reference to FIG. 6 there is shown (not to scale) dimensions of the preferred embodiment of FIG. 5A, all measurements in mm. The first (lower most) level is comprised of 3 peeler cores, of length 500 mm, 2150 mm and 500 mm. The second level is comprised of 2 peeler cores, of length 1000 mm, and 2150 mm. The third level is comprised of 2 peeler cores, of length 2150 mm, and 1000 mm. The fourth level is comprised of 3 peeler cores, of length 500 mm, 2150 mm, and 500 mm. The second level is comprised of 2 peeler cores, each of length 1575 mm.

The acute and obtuse fasteners each form an angle of 53 degrees with the long axis of the member.

Figure 3A:
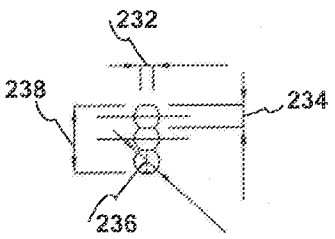

The total height of the five stacked peeler cores is 215 mm. The cross-sectional profile of the peeler cores is the same as shown in FIG. 3A.

Having the benefit of this disclosure, the skilled person is able through routine experimentation or trial and error to identify points along a beam where an advantage is gained by drilling of an interposed hole and the insertion of a fastener therein.

EXAMPLES

Example 1: Assessment of Three Member Beam, and Comparison with Two Member Beam A beam produced generally in accordance with the preferred embodiment above, by using three 80 mm members. This beam was compared with a beam produced generally according to PCT/AU2009/001453, by using two members of 100 mm. In both beams, fasteners were inserted alternately acutely and obtusely in a repeating V-shaped manner.

Both beams passed on strength criteria as a joist at 600 ctrs at 3.6 meter span.

Under service conditions the three member beam shows an acceptable 50% stress (F11 is 35 Mpa, and F34 is 100 Mpa).

This example demonstrates the usefulness of smaller timber rounds fabricated from wood which has previously been discarded or converted into low value products such as wood chips. Forming the smaller rounds into a three member beam using the fastening methods specified herein provides a higher value product having acceptable structural characteristics.

Example 2: Cost Benefit of Three Member Beams

Applicant proposes that when using the same diameter logs with stiffness defined by reference to the moment of inertia ($1=bd^3/12$), and assuming that stiffness is related to strength, and deflection is the limiting factor:

It will be noted in the above equation that b is a constant (being the width of beam), and so it is possible to compare $d^3$ for 1, 2, 3, 4 or more members.

For example, when considering a 10 cm diameter member. (80 cm between flats): when going from a beam having 2 members (prior art) to 3 members (a beam according to the present invention) the I values will be 16 $cm^3$ compared to 24 $cm^3$, giving a ratio of 4096:13824. This is an advantage of almost 3.3 to 1.

In light of the above it is proposed that around 50% increase in costs provides 3.3 times the strength of the prior art two member beam.

Example 3: Beam Composed of Four Members

Figure 4:
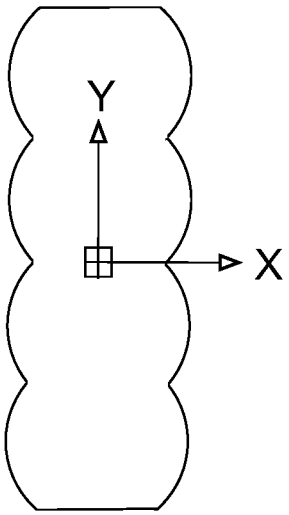
FIG. 4 shows a diagrammatic end-on view of a structural member in accordance with an embodiment of the present invention. The member is composed of four sub-members, the sub-members derived from peeler cores.

Four peeler cores (each of only 46 mm diameter) where cut to remove a slab from opposing surfaces. The slabbed cores had a first dimension of 40 mm (taken from the first planar face formed from slabbing to the second diametrically opposite planar face), and a second dimension of 184 mm. The planar faces formed cooperating surfaces where two rounds contacted. An end-on view of the assembled composite member is shown in FIG. 4. The length of the composite member was 2200 mm.

Analysis yielded the following parameters:

| | |
|---|---|
| Area: | 6306.2195 sq in |
| Perimeter: | 432.8113 in |
| Bounding box | X: −23.0769 -- 23.0769 in<br>Y: −79.9408 -- 79.9408 in |
| Centroid | X: 0.0000 in<br>Y: 0.0000 in |
| Moments of inertia | X: 13310559.5729 sq in sq in<br>Y: 880519.8341 sq in sq in |
| Product of inertia | XY: 0.0000 sq in sq in |
| Radii of gyration | X: 45.9424 in |
| Principal moments (sq in sq in) and X-Y directions about centroid | I: 880519.8341 along [0.0000-1.0000] |

The preceding description details embodiments of the invention using three rounds to form the timber structural member. It will be appreciated that the teachings herein may be applied by the skilled person in the fabrication of timber structural members having four, five, six, seven, eight or more rounds.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art.

It will be appreciated that in the detailed description and the description of preferred embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby expressly incorporated into this description, with each claim standing on its own as a separate embodiment of this invention.

Furthermore, while some embodiments described herein include some but not other features included in other embodiments, combinations of features of different embodiments are meant to be within the scope of the invention, and from different embodiments, as would be understood by those in the art. For example, in the claims appended to this description, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

The invention claimed is:

1. An extended span timber structural member comprising:

(i) two or more timber structural members arranged end-to-end, each of the two or more timber structural members comprising:

a first timber round having a first cooperating surface extending longitudinally along a length thereof, a second timber round having second and third cooperating surfaces extending longitudinally along a length thereof, and a third timber round having a fourth cooperating surface extending longitudinally along length thereof wherein:

the first cooperating surface is shaped to cooperate with the second cooperating surface, and the third cooperating surface is shaped to cooperate with the fourth cooperating surface, the first, second and third timber rounds are secured together to form a structurally integral unit in which the first cooperating surface is in contact with the second cooperating surface, and the third cooperating surface is in contact with the fourth cooperating surface, and the first, second and third timber rounds are substantially parallel to each other, the first, second and third timber rounds are secured to each other by a plurality of fasteners spaced along a length of the member, the plurality of fasteners comprising fasteners provided at both acute and obtuse angles from a central longitudinal axis of the structural member, the fasteners extending through the first, second and third timber rounds, each of the timber rounds has opposing end faces, and the end faces of adjacent timber rounds abut each other, first recess and second recesses are formed in a cooperating surface of each of two mutually end-on abutting timber rounds so as to form a substantially continuous recess straddling the abutting end faces of the mutually end-on abutting timber rounds, and a third recess is formed in a cooperating surface of a side-on abutting timber round positioned adjacent to and abutting the mutually end-on abutting timber rounds such that the first, second and third recesses form a cavity; and (ii) a connecting member seated in the cavity, wherein the connecting member straddles (a) the abutment of the end faces of the two mutually end-on abutting timber rounds, and (b) the abutment of the cooperating surfaces of each of the mutually end-on abutting timber rounds, and the cooperating surface of the side-on abutting timber round.

2. The extended span timber structural member of claim 1, wherein the connecting member substantially fully occupies the cavity.

3. The extended span timber structural member of claim 1, wherein the end faces are staggered.

4. The extended span timber structural member of claim 1, wherein the connecting member is substantially centered on the central longitudinal axis of the member.

5. The extended span timber structural member of claim 1, wherein the connecting member is disposed substantially mid-way between two of the fasteners.

6. The extended span timber structural member of claim 1, wherein the connecting member is elongate.

7. The extended span timber structural member of claim 1 wherein the connecting member is a key.

8. The extended span timber structural member of claim 1 wherein the connecting member is generally rectangular prismatic.

9. The extended span timber structural member of claim 1 wherein at least one of the timber rounds has a diameter of less than about 60 mm.

10. The extended span timber structural member of claim 1 wherein the plurality of fasteners include adjacent fasteners provided at alternating acute and obtuse angles to the central longitudinal axis of the structural member.

11. The extended span timber structural member of claim 1 comprising one or more holes interposed between the acute and obtuse angled fasteners.

12. The extended span timber structural member of claim 1 wherein the acute and obtuse angled fasteners are disposed along a plane running along the central longitudinal axis of the timber structural member.

13. The extended span timber structural member of claim 1, wherein:

the first cooperating surface is a substantially flat surface provided by removing a minor segment along the length of the first timber round, the second cooperating surface is a substantially flat surface provided by removing a minor segment along the length of the second timber round, the third cooperating surface is a substantially flat surface provided by removing a minor segment along the length of the second timber round, and the fourth cooperating surface is a substantially flat surface provided by removing a minor segment along the length of the third timber round.

14. The extended span timber structural member of claim 1 wherein an end of the first timber round is provided with a first radial cut, and an end of the second timber round is provided with a second radial cut, and an end of the third timber round is provided with a third radial cut, the timber rounds being adjacent one another in the timber structural member, and the radial cuts shaped and positioned to allow the timber structural member to engage with a further member, the further member having a rounded cross-section.

15. The extended span timber structural member of claim 1 wherein an end of the first timber round is provided with a first axial bore sized to receive a first connecting dowel, and an end of the second timber round is provided with a second axial bore sized to receive a second connecting dowel, and an end of the third timber round is provided with a third axial bore sized to receive a third connecting dowel, the ends of the first, second, and third timber rounds being adjacent one another in the timber structural member.

* * * * *